United States Patent [19]

Golls et al.

[11] 4,129,407

[45] Dec. 12, 1978

[54] CURVATURE AND PRESSURE REGULATOR FOR TROWELLING BARS OF MASTIC APPLICATOR AND FINISHING TOOLS

[75] Inventors: John W. Golls, St. Albert; Peter Griep, Edmonton, both of Canada

[73] Assignee: Custom Tool & Die Ltd., Edmonton, Canada

[21] Appl. No.: 859,998

[22] Filed: Dec. 13, 1977

[51] Int. Cl.[2] ..... B28B 3/00; B29C 3/04; B05C 17/10; E01C 19/12

[52] U.S. Cl. ..... 425/87; 425/458; 15/235.8

[58] Field of Search ..... 425/87, 458, 375; 15/235.8; 404/96, 97; 30/170, 172

[56] References Cited

U.S. PATENT DOCUMENTS

| | | | |
|---|---|---|---|
| 2,947,017 | 8/1960 | Dybdahl | 15/235.8 |
| 2,984,857 | 5/1961 | Ames | 425/87 |
| 2,999,433 | 9/1961 | Baltes | 404/96 |

*Primary Examiner*—Francis S. Husar
*Assistant Examiner*—John S. Brown
*Attorney, Agent, or Firm*—Stanley G. Ade

[57] ABSTRACT

A mastic applicator and finishing tool is provided with a trowelling bar and means are included to adjust and regulate the pressure upon said bar so that the crowning of mastic applied by the tool, may be controlled. A sliding ramp component may be moved in side to side, each position being stabilized by the engagement of a cross pin or pawl within any one of a plurality of notches in the components which are situated at an angle to the base or to the trowelling bar of the device. Means extend between the pin and the trowelling bar so that each notch engages the pawl and applies different pressure upon the trowelling bar. The notches are identified by indicia for ease of ascertaining the setting of the ramp.

12 Claims, 6 Drawing Figures

CURVATURE AND PRESSURE REGULATOR FOR TROWELLING BARS OF MASTIC APPLICATOR AND FINISHING TOOLS

BACKGROUND OF THE INVENTION

This invention relates to new and useful improvements in curvature and pressure regulators for trowelling bars of mastic and finishing tools.

Such tools are used for discharging and smoothing a layer of mastic material over a junction between adjacent wall boards or the like and it is desirable that a slight crown be formed on this mastic as it is discharged with the crown being determined by the pressure upon the trowelling bar which forms part of the tool.

U.S. Pat. No. 2,984,857 shows one method of adjusting the pressure upon the trowelling bar and hence the crown formed on the mastic material, but this particular device is somewhat difficult to adjust, particularly during the use and gives a relatively coarse adjustment between adjacent flats which requires complete redesign if finer adjustment is required.

SUMMARY OF THE INVENTION

The present invention overcomes this disadvantage by providing a different form of adjustment operating on a slightly different principle which is easily adjustable by the operator and which is readily designed to give a relatively fine adjustment between adjacent positions. Furthermore, if a different range of adjustment is required, it is relatively simply to substitute one ramp for another without having to alter the basic structure inasmuch as the angle of inclination of the notched portion is readily varied from ramp to ramp.

One aspect of the invention comprises means including a ramp component mounted for sideways movement relative to said trowelling bar, a notched ramp formed in said component extending at an angle inclined to the longitudinal axis of the trowelling bar and means interposed between said notched ramp and said trowelling bar and selectively engageable with said notched ramp whereby pressure upon said trowelling bar is progressively increased when said notched ramp component is moved sideways in one direction and decreased when said notched ramp is moved sideways in the opposite direction, said last mentioned means including a resilient strip having a first support means adjacent each end of said strip and a second support means intermediate the ends of said strip, one of said support means being operatively connected to said ramp component, the other of said support means being operatively connected to said trowelling bar.

Another aspect of the invention is to provide a device of the character herewithin described in which the angle of inclination and hence the degree of adjustment is readily varied merely by changing the ramp component.

Another aspect of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, our invention consists essentially in the arrangement and construction of parts all as hereinafter more particularly described, reference being had to the accompanying drawings in which:

DESCRIPTION OF THE FIGURES

In the drawings like characters of reference indicate corresponding parts in the different figures.

BRIEF DESCRIPTION

Before describing the invention, the mastic applicator and finishing tool will first be described.

It comprises an enclosure or container collectively designated 10 having a base side or panel 11, a pair of ends 12 and an arcuately curved rear or trailing side 13.

Figure 3:
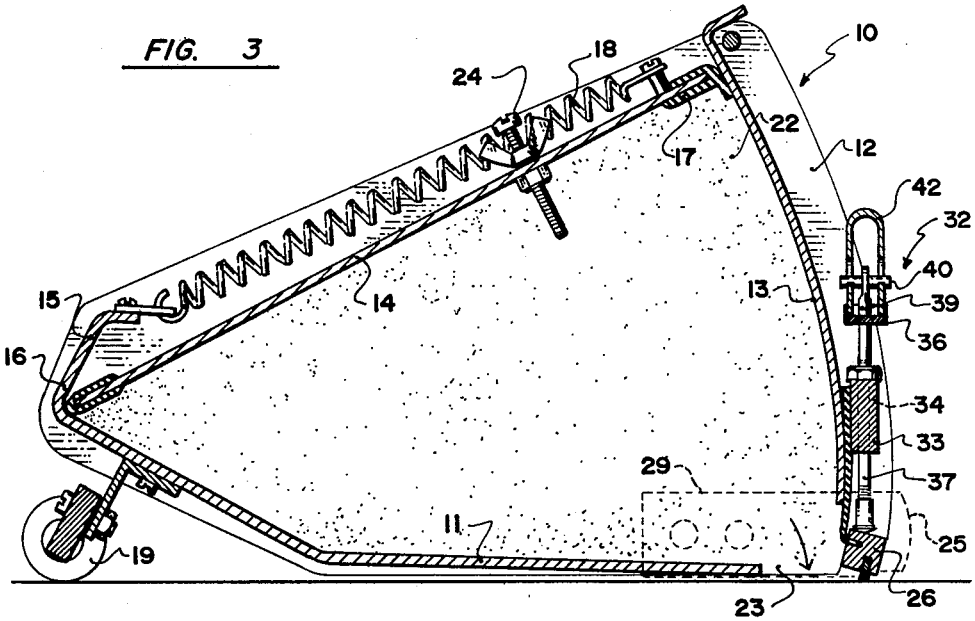
FIG. 3 is a cross sectional side elevation of the tool with the invention incorporated therein.

A hinged side 14 is pivoted adjacent the upper side 15 of the curved end portion 16 at the base 11 and this hinged side includes a wiper portion 17 on the other end thereof which is in wiping engagement with the inner surface of the arcuately curved side 13. One or more springs 18 react to normally urge the hinged side 14 to the uppermost or closed position illustrated in FIG. 3.

Rollers 19 are mounted adjacent one end of the base side 11 and a trowelling bar assembly collectively designated 20 spans the opposite end adjacent the junction between the base 11 and the curved trailing side 13. The rollers and the trowelling bar assembly 20 served to support the device upon a surface 21 upon which mastic material 22, within the container, is discharged through an outlet 23 upon the surface and trowelled in a crowned effect by means of the trowelling bar assembly 20 as clearly shown schematically in FIG. 1.

It should be understood that an attachment (not illustrated) is attached to the hinged side 14 by means of wing nut and bolt assembly 24 to draw the device over the surface 21 and to apply pressure upon the hinged wall 14 which ejects the mastic through the discharge opening 23.

The trowelling bar assembly 20 includes a pair of adjustable side portions 25 secured to the side walls 12 and carrying a resilient trowelling bar support member 26 recessed within slots 27 formed in the plate 25 and retained by lip 28 extending forwardly from the base of the clamp plate 29 which holds the support plate 25 to the side 12. The trowelling bar per se 30, is held within an elongated slot formed in the trowelling bar support 26. The support is notched as at 31 so that it is somewhat flexible whereby it may be bowed by pressure upon the discharging mastic as the crown strip is formed.

All of the foregoing is conventional and does not form part of the present invention.

DETAILED DESCRIPTION

The invention collectively designated 32 consists of means to adjust the flexibility of the trowelling bar support member 26 and the trowelling bar 30.

Figure 1:
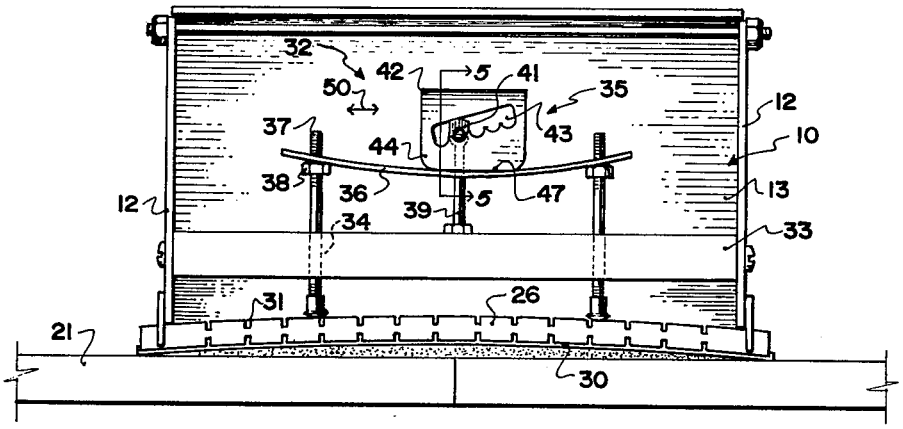
FIG. 1 is a rear elevational view of a tool incorporating the invention and showing the preferred embodiment.

A transverse support 33 spans the arcuately curved side 13 spaced from the lower edge thereof and, in the preferred embodiment shown in FIG. 1, it is provided with vertical drillings 34 spaced inwardly from the ends thereof.

A ramp component collectively designated 35 frictionally engages upon an elongated resilient spring strip or lever 36 which is notched or apertured at the ends thereof (not illustrated) to engage over the upper ends of screw threaded rods 37 which are mounted for vertical movement within the aforementioned drillings 34. Nuts 38 engage the screw threaded rods 37 and may be adjusted within limits to adjust the position of the ends of the strip 36 relative to the rods 37.

Figure 5:
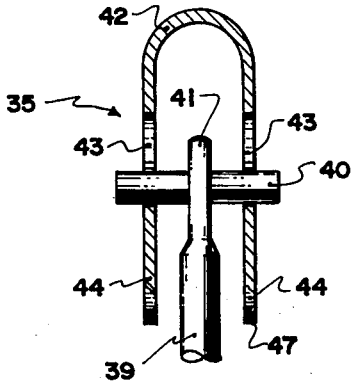
FIG. 5 is a cross sectional view of the ramp component along the line 5-5 of FIG. 1.
Figure 6:
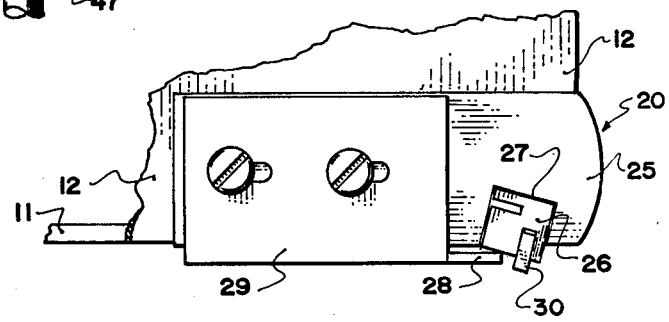
FIG. 6 is an enlarged fragmentary end elevation showing the attachment of the trowelling bar.

The further rod 39 is secured by the lower end thereof to the support 33 and extends upwardly through an aperture within the strip 36 and terminates in a cross pin 40 extending upon each side of the upper end 41 of the rod 39 as clearly shown in FIG. 5.

The ramp component comprises an inverted U-shaped substantially rectangular plate 42 having a closed ended slot 43 formed through each side portion 44 thereof with the lower surface 45 of the slot being provided with a plurality of notches thus forming a plurality of seats 46 and it will be noted that the longitudinal axis of this slot is inclined at an angle to the base 47 of the component 35 and to the base of the tool with the pin seating in opposing seats of the two notched ramps formed in the side portions 44.

The lower edges 47 of the side portions 44 engage the aforementioned resilient strips 36 and apply downward pressure thereto, said pressure depending upon the seat within which the cross pin 40 is engaged.

It will therefore be seen that the component 35 may be moved sideways to one side or the other thus causing the cross pin 40 to engage consecutive seats 46 thus varying the pressure upon the strip 36 and hence the pressure on the trowelling bar support 26 and the trowelling bar 30.

Indicia 48 indicate individual seats 46 so that the exact position can readily be ascertained and changed, if necessary.

The rounded upper surface 49 of the component 35 is readily engaged by the thumb of the operator and moves in either direction as indicated by double-headed arrow 50 thus making the adjustment extremely simple.

As mentioned previously, by changing the inclination of the slot 43, the degree of setting between adjacent seats may be varied.

Figure 2:
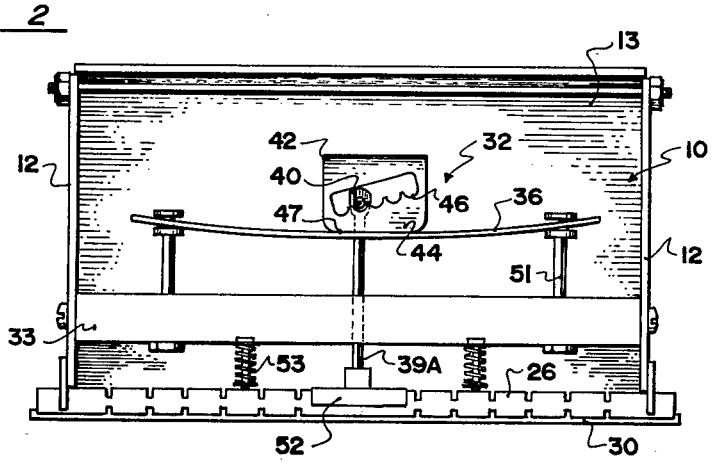
FIG. 2 is a view similar to FIG. 1 showing an alternative embodiment.
Figure 4:
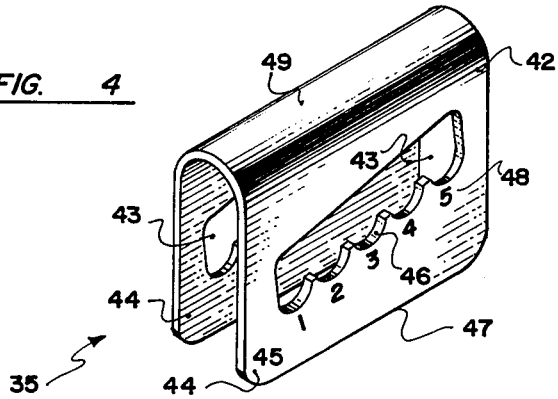
FIG. 4 is an enlarged isometric view of one embodiment of the ramp component.

FIG. 2 shows an alternative embodiment in which the strip 36 is supported adjacent the ends thereof by support rods 51 extending upwardly from the support 33. In this embodiment, the rod 39A extends downwardly from the cross pin 40 and is secured by means of clip 52, to adjacent the center of the trowelling bar support 26.

In this embodiment, the rod 39A is urged upwardly by the resilient strip 36 and will pull the center of the trowelling component upwardly thereby arching the trowelling bar or component. A pair of coil springs 53 extend between the support 33 and the trowelling bar support 26 to resist upward arching of the trowelling bar support.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention is:

1. In a mastic applicator and finishing tool movable over a surface for discharging mastic on the surface and which includes a resilient trowelling bar carried by the tool for trowelling a crown on the discharged mastic; the improvement which comprises means to regulate, within limits, the curvature of the trowelling bar, said means including a ramp component mounted for sideways movement relative to said trowelling bar, a notched ramp formed in said component extending at an angle inclined to the longitudinal axis of the trowelling bar and means interposed between said notched ramp and said trowelling bar and selectively engageable with said notched ramp whereby pressure upon said trowelling bar is progressively increased when said notched ramp component is moved sideways in one direction and decreased when said notched ramp component is moved sideways in the opposite direction, said last mentioned means including a resilient strip having a first support means adjacent each end of said strip and a second support means intermediate the ends of said strip, one of said support means being operatively connected to said ramp component, the other of said support means being operatively connected to said trowelling bar.

2. The improvement according to claim 1 in which said first support means is operatively connected to said trowelling bar and said second support means is operatively connected to said ramp component.

3. The improvement according to claim 1 in which said first support means is operatively connected to said ramp component and said second support means is operatively connected to said trowelling bar.

4. The improvement according to claim 1 in which said ramp component includes a substantially rectangular plate, a closed ended slot formed through said plate and extending at an angle inclined to the base of said plate, the lower edge of said slot being notched to form a plurality of pin engaging seats, each seat progressively increasing in distance from said plate, and a cross pin secured to the upper end of said means interposed between said notched ramp and said trowelling bar and engaging any one of said seats.

5. The improvement according to claim 2 in which said ramp component includes a substantially rectangular plate, a closed ended slot formed through said plate and extending at an angle inclined to the base of said plate, the lower edge of said slot being notched to form a plurality of pin engaging seats, each seat progressively increasing in distance from said plate, and a cross pin secured to the upper end of said means interposed between said notched ramp and said trowelling bar and engaging any one of said seats.

6. The improvement according to claim 3 in which said ramp component includes a substantially rectangular plate, a closed ended slot formed through said plate and extending at an angle inclined to the base of said plate, the lower edge of said slot being notched to form a plurality of pin engaging seats, each seat progressively increasing in distance from said plate, and a cross pin secured to the upper end of said means interposed between said notched ramp and said trowelling bar and engaging any one of said seats.

7. The improvement according to claim 1 in which each notch is identified by a distinctive indicia whereby the curvature of the crown formed on the discharged mastic may be ascertained in advance by the position of said means interposed between said notched component and said trowelling bar, engaging one of said notches.

8. The improvement according to claim 2 in which each notch is identified by a distinctive indicia whereby the curvature of the crown formed on the discharged mastic may be ascertained in advance by the position of said means interposed between said notched component and said trowelling bar, engaging one of said notches.

9. The improvement according to claim 3 in which each notch is identified by a distinctive indicia whereby the curvature of the crown formed on the discharged mastic may be ascertained in advance by the position of said means interposed between said notched component and said trowelling bar, engaging one of said notches.

10. The improvement according to claim 4 in which each seat is identified by a distinctive indicia whereby the curvature of the crown formed on the discharged mastic may be ascertained in advance by the position of said cross pin within one of said seats.

11. The improvement according to claim 5 in which each seat is identified by a distinctive indicia whereby the curvature of the crown formed on the discharged mastic may be ascertained in advance by the position of said cross pin within one of said seats.

12. The improvement according to claim 6 in which each seat is identified by a distinctive indicia whereby the curvature of the crown formed on the discharged mastic may be ascertained in advance by the position of said cross pin within one of said seats.

* * * * *